United States Patent [19]

Lindroth

[11] 4,333,863

[45] Jun. 8, 1982

[54] WATER RESISTANT TEXTURIZED WALL COVERINGS

[75] Inventor: Thomas A. Lindroth, Spring Valley, Calif.

[73] Assignee: Merck & Co., Inc., Rahway, N.J.

[21] Appl. No.: 233,738

[22] Filed: Feb. 12, 1981

[51] Int. Cl.[3] ..... C08L 5/00

[52] U.S. Cl. ..... 523/220; 106/209; 428/297; 428/326; 428/533; 428/537; 524/13; 524/28; 524/55; 524/434

[58] Field of Search ..... 260/17.4 ST, 9 K, 16; 106/197 C, 205, 209; 428/297, 326, 533, 537

[56] References Cited

U.S. PATENT DOCUMENTS

| | | | |
|---|---|---|---|
| 2,699,401 | 1/1955 | Grossi | 106/197 C |
| 2,789,903 | 4/1957 | Lukman et al. | 260/17.4 R |
| 3,897,577 | 7/1975 | Hymes | 427/277 |
| 4,257,768 | 3/1981 | Racciato et al. | 106/208 |
| 4,257,816 | 3/1981 | Yin et al. | 106/208 |

FOREIGN PATENT DOCUMENTS

| | | | |
|---|---|---|---|
| 2920988 | 11/1979 | Fed. Rep. of Germany | 106/197 C |

OTHER PUBLICATIONS

Kelgin ®600, Kelco Technical Bulletin PDB-2.

*Primary Examiner*—Theodore Morris
*Attorney, Agent, or Firm*—Gabriel Lopez; Hesna J. Pfeiffer

[57] ABSTRACT

Texturized wall coverings comprising inexpensive materials such as paper pulp fibers, textile linters, and cotton threads can be made water resistant by the incorporation therein of a blend of tamarind gum, algin, and, optionally, guar gum.

9 Claims, No Drawings

WATER RESISTANT TEXTURIZED WALL COVERINGS

BACKGROUND OF THE INVENTION

Texturized wall coverings made from various blends of inexpensive materaials are used in many parts of the world to beautify walls made of gypsum, plaster, paper, stucco, etc. These wall coverings vary greatly in compositions but generally contain primarily materials such as paper pulp, fibers, textile linters, cotton and polyeter threads, wood chips, grain shafts, and mica, as well as other minor components. The binder used to adhere these materials to the wall surface typically is carboxymethylcellulose (CMC), or similar modified, water-soluble cellulosic thickener. A problem with CMC is that it is not very water resistant. Therefore, water cannot be used in cleaning walls coated with a CMC-bound covering. Also, if the walls are accidentally wetted or if they are exposed over a prolonged period of time to hydrostatic pressure, the CMC-bound covering can peel or flake off. SUMMARY OF THE INVENTION It has now been found that in such texturized wall coverings a blend of algin, tamarind gum, and, optionally, guar gum used as a replacement for or in addition to CMC produces a water-resistant wall covering. The adhesiveness of this covering is sufficient to allow coating surfaces such as vinyl wallpaper, metal, and glass.

DETAILED DESCRIPTION OF THE INVENTION

Algin is a water-soluble polysaccharide found in all species of Phaeophyceae, brown algae. The generic term algin designates the derivatives of alginic acid chemically extracted from Phaeophyceae. The derivatives of alginic acid include varied soluble salts (e.g., sodium, potassium, or ammonium alginate) and salts of its ethers (e.g., propylene glycol alginate); these derivatives, i.e., algin, are stored in their dry-powdered form. Algin is used in commercial gum applications for its thickening, suspending, emulsifying, stabilizing, adhesive, film-forming, and gel-forming properties.

As used herein TKP refers to (1) tamarind kernel powder, a commercially available product made by husking and milling the seed kernels of the tree *Tamarindus indica Linn;* (2) cold-water soluble tamarind kernel powder (CWSTKP, which is taught in EPO 11,951, published June 11, 1980); (3) tamarind polysaccahride, which is taught in U.S. Pat. No. 3,399,189 and U.S. Pat. No. 3,287,350 (also known as tamarind seed jellose and tamarind seed pectin); and (4) other tamarind kernel power constituents, i.e., the residual after the tamarind polysaccharide has been removed, viz. a combination of proteins, fiber, fat, inorganic salts, free sugars, and tannins.

Guar gum is a commercially available product which is essentially the endosperm of the plant *Cyanaposis tetragonolobus,* family Leguminosae. Guar gum is used extensively as an additive in paper manufacturing as an aid in fiber-fiber bonding. Guar gum is also used as a flocculating agent in the mining industry sice it flocculates clays, carbonates, hydroxides and silica.

Algin and TKP can be blended to any desired ratio and stored as a blend until needed. These two components may be combined, each as a dry powder and stored as a dry-powder blend, or they initially may be put separately into solution and then the two solutions combined in the final formulation. As tamarind kernel powder is not soluble in cold water, its entry into solution requires heating to approximately 82° C. Agitation by a mixer may also be required to put algin and tamarind kernel powder into solution. Due to its ease of solubility in cold water, blends using CWSTKP are preferred.

Blends of algin and TKP in the weight:weight ratios of 90:10 to 5:95 are useful in this invention. Blends low in algin are preferred; i.e., algin:TKP<50:50. Most preferred are those in the range 20:80 to 5:95.

When guar is also used, the ratio of algin:(TKP plus guar gum) on a weight:weight basis can range from about 90:10 to about 5:95.

The amounts of each gum in said novel blend can range, based on weight, as follows:

| | |
|---|---|
| algin | 5%–90% |
| TKP | 5%–90% |
| guar gum | 5%–90% |

Blends low in algin are preferred; i.e., algin:(TKP+guar gum)<50:50. Most preferred are blends in the range 20:80 to 5:95. A most preferred blend is 20:50:30, algin:TKP:guar gum. Insofar as the gums themselves are concerned, high viscosity sodium alginate and cold-water soluble tamarind gum are preferred. For rapid hydration, a through 80-mesh product is desirable.

For improved mildew resistance, a di- or tri-valent metal salt may be incorporated into the wall coating at a level of about 1%, based on weight of gum. Zinc carbonate is preferred as an aid in water resistance, and as a mildew and fungus inhibitor.

A wall covering of this invention would contain at least about 75% of the following materials:

| MATERIAL | RANGE BY WT. | MAXIMUM SIZE |
|---|---|---|
| Paper Pulp Fibers | 10–30% | 5 mm length |
| Textile Linters | 10–30% | 5 mm length |
| Cotton Threads | 5–15% | 3 mm length |
| Polyester Threads | 5–15% | 3 mm length |
| Wood Chips | 40–60% | 1 mm diameter |
| Grain Shafts | 5–10% | 10 mm length |

Optionally, up to about 25% of the following materials may be used:

| MATERIAL | RANGE BY WT. | MAXIMUM SIZE |
|---|---|---|
| Mica | 1–5% | 0.1 mm diameter |
| Clays | 5–15% | 50 micron diameter |
| Metal (e.g. aluminum) Flakes | 1–5% | 0.5 mm diameter |
| Modified cellulosic (e.g. CMC) | 5–15% | |
| Dyes | 0.5–1% | |

The cellulosic should be larger than about 80-mesh. The dyes are selected on the basis of compatibility with the particular fibers to be dyed and the color effect desired in the final product.

Additional optional materials include plastics and waste textile fibers of sizes comparable to those above.

The gum blend of this invention is incorporated into the above material at a level of about 3.0% to about 20.0% (wt./wt.). A preferred range is 5.0% to 12.0%.

In preparing the wall covering for use, the dry ingredients are combined with water and mixed thoroughly until a plaster-like consistency is obtained. The material is then troweled onto the surface to be covered so as to achieve about a 2 mm coat on the surface. For particularly troublesome surfaces, a second coat can be applied after the first has dried. The best applications are on clean surfaces which are free of loose material. The wall covering of this invention can be used on gypsum, plaster, paper, stucco, concrete, block, brick, previously painted, vinyl wallpaper, wood, metal, and glass walls.

The invention is further defined by reference to the following examples, which are intended to be illustrative and not limiting.

In the examples reference is made to various tests. The test protocols are as follows:

PREPARATION OF POROUS AND NON-POROUS SUBSTRATES

Samples were applied to both standard unsealed paint draw down sheets and glass plates at ≈2 mm in thickness. These panels were then air dried at ambient temperature for 48 hours.

EASE OF APPLICATION

Each sample was applied with a trowel to 2 mm thickness. The amount of work and time required to achieve the most uniform coating was subjectively evaluated by each sample on the glass substrate.

UNIFORMITY

After drying, each of the samples applied to the glass plates was evaluated for light transmittance through the coating. A small amount of light was interpreted as good uniformity, large gaps and holes with large amounts of light were interpreted as poor uniformity.

EASE OF REMOVAL (ADHESION TEST)

After drying, each sample on the draw down sheet was tested for ease of removal. This was determined by using a half inch wide round nose spatula at both the edge of the coating and at the center. A rating was given to the amount of work to remove one square inch of material.

ABRASION RESISTANCE (COHESION TEST)

After drying, each sample on a glass substrate was rubbed with a Scott® abrasive pad (1"×3") and the number of strokes to remove the coating was used to determine the cohesive strength of each binder.

WATER RESISTANCE

After drying, each sample of the glass substsrate was immersed in de-ionized water and observed. The time was recorded at which the coating lost adhesion to the substrate and at which the coating began to disintegrate and lose cohesion.

EXAMPLE 1

SAMPLE PREPARATION

A commercially available wall covering (Colorwall) was used as a control. The cellulosic material in this wall covering was removed by dissolution and filtering and rinsing in D.I. water to produce a substantially cellulosic-free fibrous sample to which various gums were added. Four samples were thus prepared using tap water:

| | | |
|---|---|---|
| Sample 1 | 100.0 g | Colorwall |
| | 584.0 g | water |
| Sample 2 | 90.0 g | fibers |
| | 18.0 g | CWSTKP |
| | 584.0 g | water |
| Sample 3 | 90.0 | fibers |
| | 7.8 g | KELGIN 600®* |
| | 584.0 g | water |
| Sample 4 | 90.0 | fibers |
| | 7.8 g | KELGIN 600® |
| | .08 g | $ZnCO_3$ |
| | 584.0 g | water |

*A commercially available blend of algin, guar, and TKP (Kelco Division of Merck & Co., Inc., San Diego, Calif.).

EXAMPLE 2

MISCELLANEOUS TESTS

| Sample | Ease of Application | Uniformity | Ease of Removal |
|---|---|---|---|
| 1 | Fair | Fair | Difficult |
| 2 | Good | Fair | Difficult |
| 3 | Excellent | Excellent | Difficult |
| 4 | Excellent | Excellent | Difficult |

| Sample | Abrasive Resistance | Water Resistance | |
|---|---|---|---|
| | | Release | Distint. |
| 1 | Fair | 5 min. | 10 min. |
| 2 | Fair | 5 min. | 10 min. |
| 3 | Fair | 72 hrs. | 72 hrs. |
| 4 | Fair | 72 hrs. | 72 hrs. |

What is claimed is:

1. A wall covering composition comprising at least 75% of

| MATERIAL | RANGE BY WT. | MAXIMUM SIZE |
|---|---|---|
| Paper Pulp Fibers | 10–30% | 5 mm length |
| Textile Linters | 10–30% | 5 mm length |
| Cotton Threads | 5–15% | 3 mm length |
| Polyester Threads | 5–15% | 3 mm length |
| Wood Chips | 40–60% | 1 mm diameter |
| Grain Shafts | 5–10% | 10 mm length |

and about 3 to about 20 wt.% of a gum blend comprising algin and TKP in the weight:weight ratios of 20:80 and 5:95.

2. A composition of claim 1 further comprising up to 25% of

| MATERIAL | RANGE BY WT. | MAXIMUM SIZE |
|---|---|---|
| Mica | 1–5% | 0.1 mm diameter |
| Clays | 5–15% | 50 micron diameter |
| Metal (e.g., aluminum) Flakes | 1–5% | 0.5 mm diameter |
| Modified cellulosic | 5–15% | |
| Dyes | 0.5–1% | |

3. A composition of claims 1 or 2 further comprising about 1% $ZnCO_3$.

4. A composition of claims 1 or 2 wherein the gum blend is

| | |
|---|---|
| Algin | 5–20% |
| TKP | 5–90% |
| Guar gum | 5–90% |

with the proviso that the ratio of algin:(TKP plus guar gum) on a weight:weight basis range from about 20:80 to about 5:95.

5. A composition of claim 4 wherein the algin is sodium alginate or propylene glycol alginate and the TKP is cold-water soluble tamarind kernel powder.

6. A composition of claim 4 wherein the algin is high viscosity sodium alginate.

7. A composition of claim 6 wherein the TKP is cold-water soluble tamarind kernel powder and the algin:TKP:guar gum ratio is 20:50:30.

8. A composition of claim 7 wherein the gum blend is about 5 to 12 wt.%.

9. A process for coating a wall which comprises applying to said wall a trowelable, aqueous composition comprising about 3 to 20 wt.% of a blend of algin (5–20%), TKP (5–90%), guar gum (5–90%) with the proviso that the ratio of algin:(TKP plus guar gum) on a weight:weight basis range from about 20:80 to about 5:95, and at least 75%

| MATERIAL | RANGE BY WT. | MAXIMUM SIZE |
|---|---|---|
| Paper Pulp Fibers | 10–30% | 5 mm length |
| Textile Linters | 10–30% | 5 mm length |
| Cotton Threads | 5–15% | 3 mm length |
| Polyester Threads | 5–15% | 3 mm length |
| Wood Chips | 40–60% | 1 mm diameter |
| Grain Shafts | 5–10% | 10 mm length |

and no more than 25%

| MATERIAL | RANGE BY WT. | MAXIMUM SIZE |
|---|---|---|
| Mica | 1–5% | 0.1 mm diameter |
| Clays | 5–15% | 50 micron diameter |
| Metal (e.g., aluminum) Flakes | 1–5% | 0.5 mm diameter |
| Modified cellulosic | 5–15% | |
| Dyes | 0.5–1% | |

* * * * *